US005629724A

United States Patent [19]

Elrod et al.

[11] Patent Number: 5,629,724

[45] Date of Patent: May 13, 1997

[54] STABILIZATION OF THE FREE SURFACE OF A LIQUID

[75] Inventors: Scott A. Elrod, Redwood City; Butrus T. Khuri-Yakub, Palo Alto; Calvin F. Quate, Stanford, all of Calif.

[73] Assignee: Xerox Corporation, Stamford, Conn.

[21] Appl. No.: 890,995

[22] Filed: May 29, 1992

[51] Int. Cl.[6] ..... B41J 2/04

[52] U.S. Cl. ..... 347/10; 347/46

[58] Field of Search ..... 346/140 R, 1.1; 347/9–11, 46, 94

[56] References Cited

U.S. PATENT DOCUMENTS

| | | | |
|---|---|---|---|
| 4,266,232 | 5/1981 | Juliana et al. | 347/10 |
| 5,107,276 | 4/1992 | Kneezel et al. | 347/60 |
| 5,122,818 | 6/1992 | Elrod et al. | 347/46 |
| 5,172,134 | 12/1992 | Kishida et al. | 347/13 |

FOREIGN PATENT DOCUMENTS

| | | | |
|---|---|---|---|
| 0243117 | 10/1987 | European Pat. Off. . | |
| 0243118 | 10/1987 | European Pat. Off. . | |
| 0273664 | 7/1988 | European Pat. Off. | B41J 3/04 |
| 62-222853A | 9/1987 | Japan . | |
| 1-026454 | 1/1989 | Japan | B41J 3/04 |
| 1141056A | 2/1989 | Japan . | |

*Primary Examiner*—Joseph W. Hartary

[57] ABSTRACT

Techniques for obtaining an ejection rate independent, spatial relationship between an acoustic focal area and the free surface of a liquid. Variations in the spatial relationship are reduced or eliminated by applying substantially the same acoustic energy to the liquid's free surface during periods when droplets are not ejected as when they are, but at power levels insufficient to eject a droplet. During ejection periods in which a droplet is not ejected, the acoustic energy is applied at a lower level, but for a longer time. Because it is more convenient to measure and control, the transducer drive voltage is used to control the acoustic energy applied to the liquid's free surface.

2 Claims, 2 Drawing Sheets

STABILIZATION OF THE FREE SURFACE OF A LIQUID

BACKGROUND OF THE PRESENT INVENTION

Various ink jet printing technologies have been or are being developed. One such technology, referred to hereinafter as acoustic ink printing (ALP), uses acoustic energy to produce an image on a recording medium. While more detailed descriptions of the AIP process can be found in U.S. Pat. Nos. 4,308,547, 4,697,195, and 5,028,937, essentially, bursts of acoustic energy focused near the free surface of a liquid ink cause ink droplets to be ejected onto a recording medium.

As may be appreciated, acoustic ink printers are sensitive to the spatial relationship between the acoustic energy's focal area and the ink's free surface. Indeed, current practice dictates that the focal area be within about one wavelength (typically about 10 micrometers) of the free surface. If the spatial separation increases beyond the permitted limit, ink droplet ejection may occur poorly, intermittently, or not at all.

While maintaining the required spatial relationship is difficult, the difficulty increases as droplet ejection rates change. This is because experience has shown that high droplet ejection rates cause a spatial change in the static level of the ink's free surface. This is believed to be a result of the rather slow rate of decay of mounds raised on the free surface from which droplets are ejected. Thus, in the prior art, the spatial relationship between the acoustic focal area and the ink's free surface is, undesirably, a function of the droplet ejection rates. This dependency is a problem in high speed AIP since droplet ejection rates vary as an image is produced. While the spatial variation depends upon such factors as the liquid's viscosity, the acoustic energy used to eject a droplet, and the density of droplet ejectors, static height variations about equal to the acoustic wavelength are encountered in practice. Therefore, techniques that stabilizes the spatial relationship between the acoustic focal area and the ink's free surface would be beneficial.

SUMMARY OF THE INVENTION

The present invention provides for an ejection-rate independent spatial relationship between the acoustic focal area and the free surface of a liquid, beneficially an ink or other marking fluid. Ejection rate caused variations in the spatial relationship are reduced or eliminated by applying substantially the same acoustic energy to the liquid's free surface whether a droplet is ejected or not. With the acoustic energy required to be applied to the liquid's free surface to eject a droplet determined (or a related parameter such as transducer drive voltage), a similar amount of energy is created over periods wherein droplets are not ejected, but with impulse characteristics insufficient for droplet ejection. Because it is more convenient to measure and control, the transducer drive voltage is beneficially controlled to obtain the desired acoustic energy patterns.

BRIEF DESCRIPTION OF THE DRAWINGS

Other aspects of the present invention will become apparent as the following description proceeds and upon reference to the drawings, in which.

In the drawings, like references designate like elements.

DETAILED DESCRIPTION OF THE ILLUSTRATED EMBODIMENT

Figure 1:
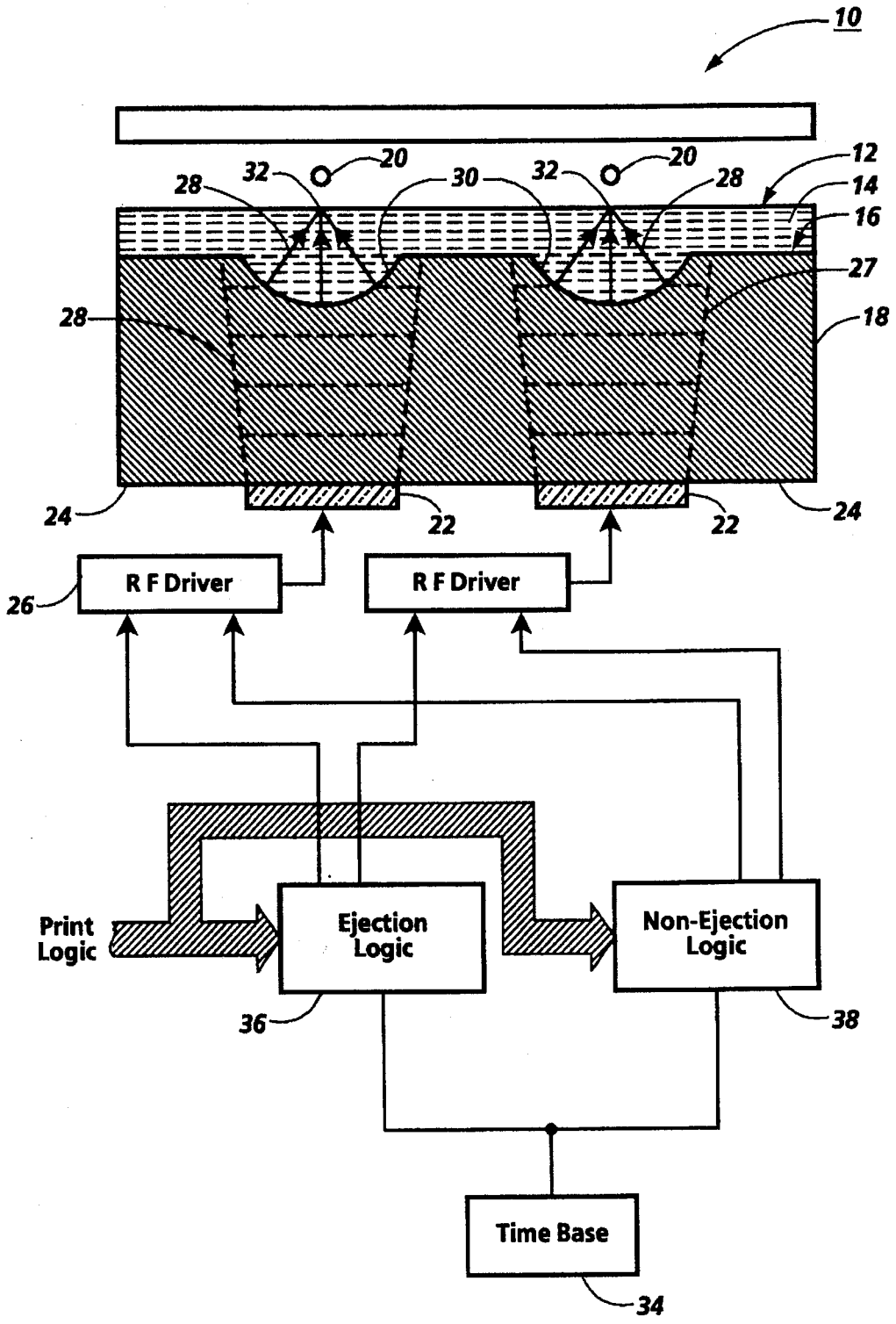
FIG. 1 shows a simplified, pictorial diagram of an acoustic ink printer according to the principles of the present invention.

Refer now to FIG. 1, wherein an acoustic ink printer 10 according to the present invention is illustrated. The present invention spatially stabilizes the free surface 12 of a liquid ink 14 relative to the top surface 16 of a body 18, despite varying ejection rates of droplets 20 from the free surface. The acoustic energy that induces droplet ejection is from an associated one of a plurality of transducers 22 attached to the bottom surface 24 of the body. When a voltage impulse having a crest above a certain threshold voltage $V_T$ is input to a transducer from an RF driver 26, the transducer generates acoustic energy 28 which passes through the body 18 until it reaches an associated acoustic lens 30. The acoustic lens focuses the acoustic energy into a small area 32 near the free surface 12 and a droplet 20 is ejected.

Without corrective measures the relative position of the free surface 12 and the top surface 16 is a function of the droplet ejection rate. This dependency is reduced or eliminated by applying substantially the same acoustic energy per unit time period (the ejection period) to the free surface 12 whether a droplet is ejected or not. To avoid undesired droplet ejection, the characteristics of the acoustic energy is changed, such as by reducing its peak levels while increasing its duration. The ejection period, $T_P$, is the reciprocal of the maximum droplet ejection rate and is assumed to be significantly shorter than the recovery time of the mounds (not shown) formed when droplets are ejected. Of course, if the ejection period is longer than the recovery time stabilization is not needed.

Still referring to FIG. 1, the ejection period $T_P$ is controlled by a time base 34 applied to an ejection logic network 36 and to a non-ejection logic network 38. Also input to those networks are printer logic commands that specify, for each ejection period $T_P$, which transducers 22 are to cause droplets 20 to be ejected. For those transducers that are to eject droplets, the ejection logic network 36 applies signals to the associated RF drivers 26 to cause acoustic energy to be generated at a magnitude sufficient for ejection. For those transducers that are not to eject droplets, the non-ejection logic network 38 applies signals to the associated RF drivers 26 to cause the same acoustic energy to be generated, but with characteristics insufficient for ejection.

Figure 2:
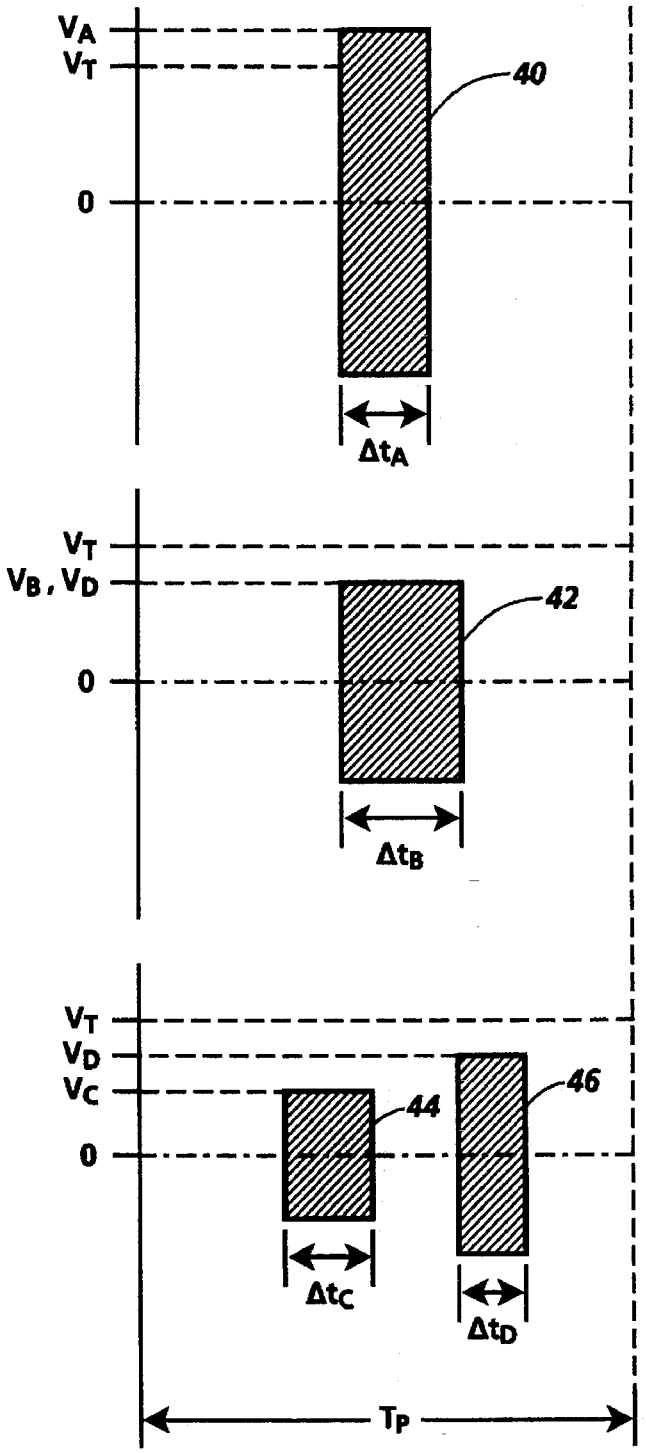
FIG. 2 shows typical transducer drive voltage verses ejection period waveforms for a period when a droplet is ejected (top graph) and for periods when a droplet is not ejected (middle and bottom graphs).

Two basic methods of maintaining the acoustic energy, and thus the location of the free surface, constant are explained with the assistance of the voltage verses time waveforms of FIG. 2. The illustrated voltages are those applied to an arbitrary transducer 22 to either eject a droplet (top graph) or to stabilize the free surface (middle and bottom graphs) plotted against an ejection period, $T_P$, that begins (time 0) prior to the voltage being applied to the transducer. Since acoustic energy is derived from a driving voltage, the use of voltage waveforms (as in FIG. 2) instead of acoustic energy waveforms is justified.

The waveform 40 (top graph) represents a typical drive signal (impulse) applied to a transducer to cause droplet ejection. Since the peak drive voltage $V_A$ is well above the minimum voltage at which a droplet is ejected, the threshold voltage $V_T$, a droplet is ejected. The energy applied to the transducer is proportional to $V_A^{2\times}\Delta t_A$, where $\Delta t_A$ is the time duration of the pulse.

According to the present invention, substantially the same energy (proportional to $V_A^2 \times \Delta t_A$) is applied to the transducer, but with characteristics which will not cause droplet ejection. One method of doing this is illustrated by the waveform 42 (middle graph). The maximum voltage $V_B$ of waveform 42 is less than the threshold voltage $V_T$; thus the waveform does not cause a droplet to be ejected. However, the total energy applied to the transducer ($V_B^2 \times \Delta t_B$) is made substantially the same as that proportional to $V_A^2 \times \Delta t_A$ by appropriately increasing $\Delta t_B$. Conceivably, $\Delta t_B$ could extend to equal $T_P$.

An alternative method of applying the same energy (proportional to $V_A^2 \times \Delta t_A$) to the transducer without ejecting a droplet is illustrated by waveforms 44 and 46 (bottom graph). Instead of one pulse, a plurality of voltage pulses are applied to the transducer. The total energy applied is made substantially equal to that proportional to $V_A^2 \times \Delta t_A$ while the peak voltage is kept well below $V_T$. It should be obvious that the characteristics of each pulse need not be the same. As shown, the peak voltage obtained by waveform 44 is $V_C$ while waveform 46 obtains $V_D$. By adjusting the sum of $V_C^2 \times \Delta t_C$ and $V_D 2 \times \Delta t_D$ to equal $V_A^2 \times \Delta t_A$ the desired result is achieved.

From the foregoing, numerous modifications and variations of the principles of the present invention will be obvious to those skilled in its art. Therefore the scope of the present invention is to be defined by the appended claims.

What is claimed:

1. An apparatus for stabilizing the spatial location of the free surface of a liquid against variations in the acoustic impulse induced rate of droplet ejection from the free surface of the liquid, the apparatus comprising:

a transducer for converting input electrical energy into acoustic radiation;

means for focusing said acoustic radiation into an area near the free surface of the liquid;

a time base for segmenting time into a plurality of ejection periods;

means for ascertaining if a droplet is to be ejected in each of said ejection periods; and a driver operatively connected to said ascertaining means and to said transducer, said driver for inputting electrical energy to said transducer to create an impulse of acoustic radiation sufficient to cause droplet ejection from the free surface of the liquid in each of said ejection periods in which a droplet is to be ejected, said driver 38 further for inputting electrical energy to said transducer sufficient to cause substantially the same acoustic radiation to be directed toward the free surface of the liquid, but with impulse characteristics insufficient to cause droplet ejection in each of said ejection periods in which a droplet is not to be ejected.

2. The apparatus according to claim 1 wherein said driver causes said transducer to generate a plurality of acoustic radiation impulses, each insufficient to eject a droplet, in each of said ejection periods in which a droplet is not to be ejected.

* * * * *